United States Patent [19]

Cash

[11] 4,013,027

[45] Mar. 22, 1977

[54] DUAL SEWING HEAD SERGING MACHINE

[75] Inventor: David R. Cash, Louisville, Ky.

[73] Assignee: James Cash Machine Co., Louisville, Ky.

[22] Filed: Apr. 1, 1976

[21] Appl. No.: 672,668

[52] U.S. Cl. ..... 112/155; 112/3 R

[51] Int. Cl.[2] ..... D05B 25/00

[58] Field of Search ..... 112/2, 3 R, 155, 219 R, 112/206, 219 A, 203, 218 R, 104, 117, 121.14, 121.15, 121.29, 153, 221, 154, 160, 217.2, 217.3, 259, 266

[56] References Cited

UNITED STATES PATENTS

| | | | |
|---|---|---|---|
| 3,749,037 | 7/1973 | Cash | 112/117 |
| 3,799,082 | 3/1974 | Redman | 112/3 R |
| 3,808,993 | 5/1974 | Heiler et al. | 112/155 |

FOREIGN PATENTS OR APPLICATIONS

| | | | |
|---|---|---|---|
| 1,485,268 | 5/1973 | Germany | 112/155 |

*Primary Examiner*—G. V. Larkin
*Attorney, Agent, or Firm*—Arthur F. Robert

[57] ABSTRACT

This serging machine uses a righthand serging sewing head for serging one edge of an elongate strip of material and another, preferably identical, righthand serging sewing head for serging the opposite edge of that same strip comtemporaneously. This is accomplished by directing the strip material from a front supply roll rearwardly through the machine along one run of a given path, turning the strip 180° at the rear end of the machine to return it forwardly through the serging machine and its feed rolls along another generally parallel run of said path and then rewinding it on a front rewind roll at the front end of said path. One edge is serged during the rearward run; the other during the forward run. First and second motors are used to drive the serging sewing heads continuously. A third motor is used not only to drive the feed rolls continuously to pull the strip through the machine but also to drive the rewind roll through a slip clutch. A fourth motor is used to drive the supply roll intermittently in a manner such that, when the slack between the supply roll and the 1st head reduces to a predetermined minimum so as to tend to tighten and stretch the rearward run, a switch starts the fourth motor to increase the slack until another switch operates to stop the fourth motor when said slack increases to a predetermined maximum degree of looseness.

3 Claims, 5 Drawing Figures

DUAL SEWING HEAD SERGING MACHINE

BACKGROUND OF THE INVENTION

1. Field of the Invention

This invention relates primarily to the bedding equipment field and more particularly to a serging machine for serging the opposite edges of an elongate strip of material, such as may be used for a mattress border panel or the like.

2. Description of the Prior Art

It is understood that the opposite edges of an elongate strip of material may be sewn at the same time by using a righthand sewing head to sew the "righthand" edge of the strip and simultaneously using a lefthand sewing head to sew the "lefthand" edge thereof. This practice requires the stocking of spare right and left hand sewing heads, one set of repair and replacement parts for the righthand head and another set of repair and replacement parts for the lefthand head.

The Redman U.S. Pat. No. 3,799,082 granted Mar. 26, 1974 shows a dual sewing head machine that uses two identical (i.e. lefthand or righthand) sewing heads. Redman accomplishes this by directing the material through one sewing head in a longitudinally rearward direction and then turning the material about a 45° bar to direct it in a lateral or transverse direction at a 90° angle to the 1st direction. Redman uses one head to sew the rearwardly moving edge and another identical head to sew the other edge when it moves laterally in said other 90° direction. This type of operation places the supply roll on the front end of the machine and the rewind roll at one side of the machine. However, with two identical heads, (i.e. righthand or lefthand), the inventory of heads and repair parts therefor is reduced in half more or less.

SUMMARY OF THE INVENTION

Objects of the Invention

The principal object of the present invention is to provide a simpler and more compact dual sewing head machine, preferably dual serging sewing heads, with both supply and rewind rolls at the same end of the machine or with the same end of the machine arranged to receive the unsewn strip from any source and to discharge the sewn strip to any receiver.

Statement of the Invention

The principal object of the present invention is achieved simply by using a 180° turn in the strip material to provide parallel rearward and forward runs of strip material so that the 1st head, of two identical serging sewing heads, can be used to serge one edge on the "rearward" run of the strip material while the other head can be used to serge the other edge on the "forward" or return run thereof. This places both supply and rewind rolls on the front end of the serging machine and otherwise helps to provide a simpler and more compact machine.

BRIEF DESCRIPTION OF THE DRAWINGS

The preferred embodiment of the invention is somewhat schematically illustrated in the accompanying drawings wherein.

DESCRIPTION OF THE PREFERRED EMBODIMENT

Figure 1:
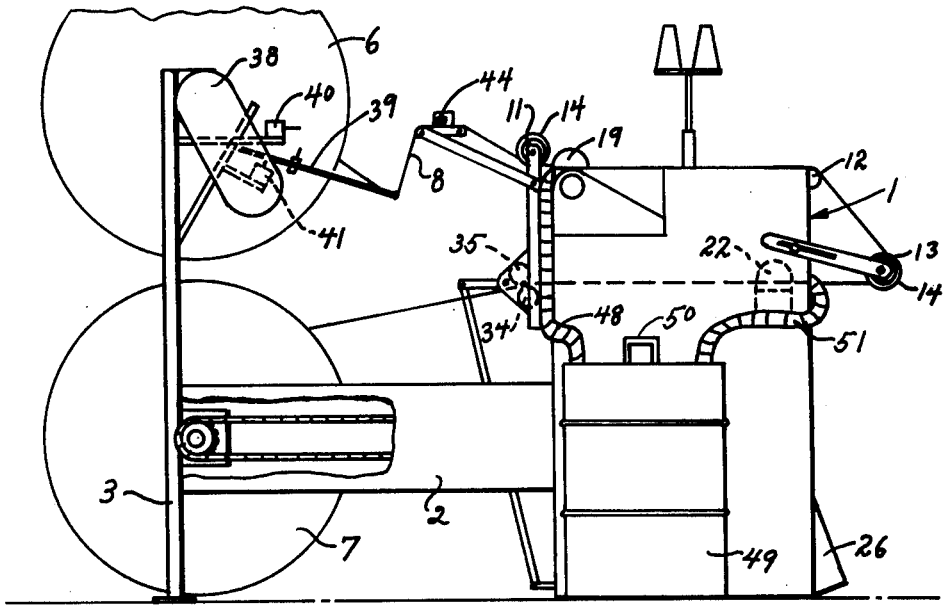
FIG. 1 is a side elevational view of the machine.

Generally speaking, my invention relates to a sewing machine for serging the opposite edges of an elongate strip of material to be used in mattresses and other products. The important elements of the preferred embodiment of my invention comprise: a turn member; means for directing a strip or panel in one direction along the 1st run of a given path extending to one side of said turn member at about a 90° angle thereto and withdrawing it from the opposite side thereof along a 2nd run of said given path extending in the opposite direction, said path having substantially parallel 1st and 2nd sewing sections respectively in the 1st and 2nd runs; a 1st serging sewing head of one hand (righthand or lefthand) type operatively mounted to sergo one edge of said strip in said 1st sewing section; and a 2nd serging sewing head of the same hand type operatively mounted to serge the opposite edge of said strip in said 2nd sewing section.

More specifically, the preferred embodiment of my invention is incorporated in a border panel or like sewing machine structure comprising: 1. a frame having front and rear ends and presenting a U-shaped path for the flow of material 1st rearwardly through the machine along one run and then, after a 180° turn, forwardly through the machine along another generally parallel run; 2. supply and rewind rolls mounted at the front end of the machine; 3. guide means for directing the material from the supply roll to the rewind roll along said U-shaped path; 4. a 1st serging sewing head of one hand type arranged along the rearward run of said path in operative position to serge one edge of said strip of material; 5. a 2nd serging sewing head of the same hand type arranged along the forward run of said path in operative position to serge the opposite edge of said strip material; 6. continuously energized motorized means for continuously operating the rewind roll to pull the strip through the machine and for continuously operating each of said 1st and 2nd serging sewing heads; 7. intermittently energized motorized means for intermittently rotating said supply roll to maintain some slack in the material between the supply roll of said rearward run and said 1st sewing head, said intermittent means including (a) means, responsive to the decrease and increase in said slack and operative, when the slack decreases to a predetermined low degree, to cause said motorized means to drive the supply roll in the direction required to increase said slack, and, when the slack increases to a predetermined high degree, to render said motorized means inoperative so as to stop the drive of the supply roll; and 8. means for sensing the tail end of the strip and operative, before that end reaches the 1st sewing head, to shut down the machine.

Machine Frame

The main or machine frame 1 is conventionally composed of four vertically arranged corner members, several horizontally arranged right and left side members and several horizontally arranged front and rear cross members, all interconnected together. These members are preferably of hollow tubular construction square in cross-section. Appropriate metal covering plates are provided for right and left sides, front and rear ends and for the top. The front end of the frame adjacent the lower right corner projects forwardly and is covered to provide a hollow extension 2 of the housing, which is connected with a roll stand 3.

Supply & Rewind Rolls

Figure 3:
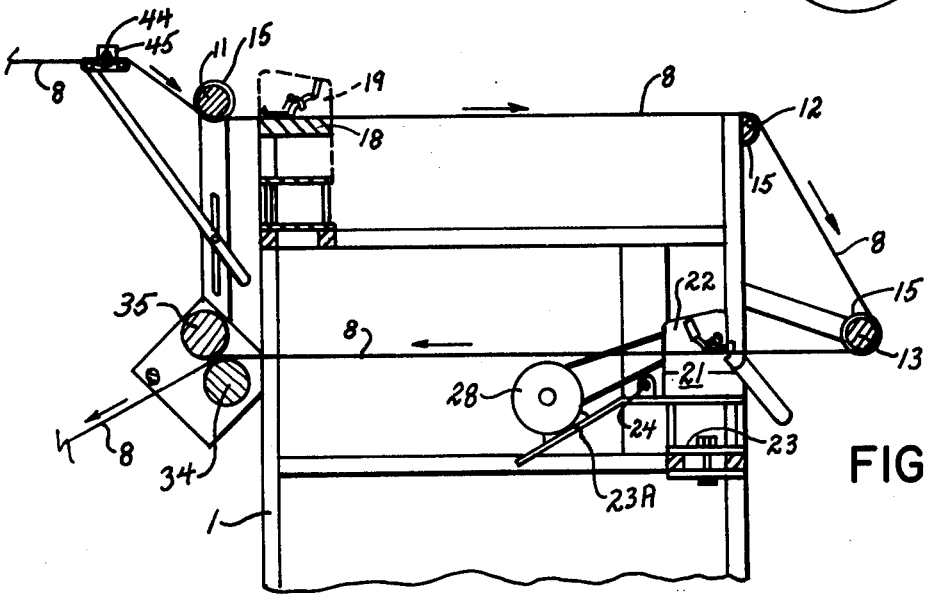
FIG. 3 is a vertical longitudinal section corresponding to one taken through the upper half of the machine along line 3—3 of FIG. 2.

The upper supply and lower rewind rolls 6 and 7 are removably mounted on the roll stand 3 with the supply roll 6 located over the rewind roll 7. FIGS. 1 and 3 show that the frame presents a horizontally arranged forwardly open U-shaped path for the flow of the panel material 8 in strip form from the top supply roll 6 rearwardly and thence forwardly through the machine back to the bottom rewind roll 7.

Guide Means

The frame 1 carries a top front roll 11, a top rear roll 12 and a lower rear roll 13. Each of these rolls is provided with a pair of collars 14, 15. Collar 14 is fixed, collar 15 adjustable so that the distance between them can be adjusted to the width of the desired panel and, when adjusted, the collars function as guides to set the path for the flow of the material 8 and guide it along that path.

First Serging Sewing Head

Below the extreme top of the machine near its front corner, the machine frame 1 carries the frame 18 of the 1st serging sewing head 19. It is mounted in a more or less fixed rigid position in any suitable conventional manner. The sewing head 19 conventionally functions: first to trim the edge of the panel; and second to sew that trimmed edge by a serging action wherein three threads are provided, one being sewn directly along a straight seam line and the other two being looped to extend around the trimmed edge of the panel. One loop extends from the top side downwardly around the edge of the panel. The other extends reversely. These loops are conventionally interlocked together.

Second Serging Sewing Head

At or about the middle level of the machine, the machine frame 1 carries the frame 21 of a 2nd serging sewing head 22, which is mounted on a slidable carriage 23 so that it may be laterally adjusted, by means of an elongate adjusting screw 24, to conform to the width of the strip being sewn.

Motorized Means — Continuous

The continuously energized motorized means for continuously operating not only the rewind roll to pull the strips through the machine but also each of the 1st and 2nd serging sewing heads, includes three motors 26, 27 and 28.

The rewind drive motor 26 is mounted on a support plate 29 which is secured to the frame and arranged to incline forwardly upward from the bottom right rear corner of the machine frame. The plate 29 is arranged in this manner to minimize the front to rear depth of the machine and thus promote compactness.

Figure 4:
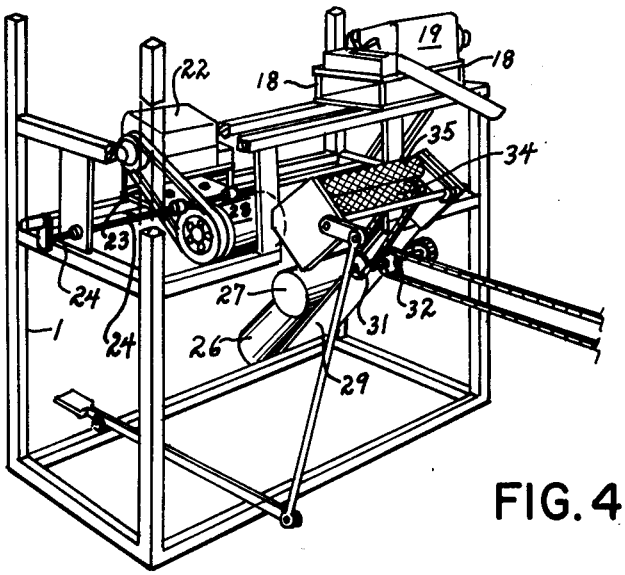
FIGS. 4 and 5 are perspective views respectively looking rearwardly at the front left corner and forwardly at the rear right corner of a partially finished dual head sewing machine primarily to show its skeleton frame, the 1st and 2nd serging sewing heads and their respective mountings and the fabric feed means, the flat metal plates of the housing walls and other details including various control switches being omitted.
Figure 5:
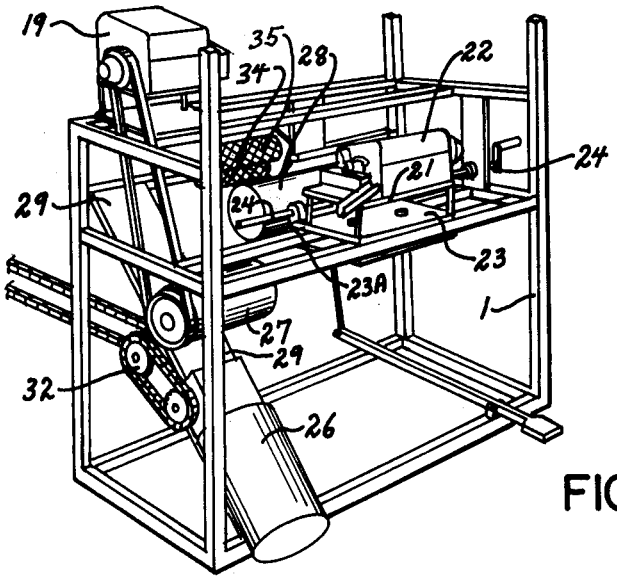

The drive shaft of rewind roll drive motor 26 has a chain connected to a cross-shaft carrying two drive sprockets 31 and 32, which are best seen in FIG. 4. The sprocket 31 chain drives the lower member of a pair of feed rolls 34, 35, which pull the material through the machine. The other drive sprocket 32 is connected to the rewind roll 7 through a chain, extending through the forward hollow extension 2 of the housing, and a slip clutch mechanism (not shown).

The sewing head drive motor 27 is also mounted on the inclined support plate 29 and belt-connected to the operating shaft of the 1st serging sewing head.

The sewing head drive motor 28 which is belt-connected to the operating shaft of the 2nd serging sewing head 22, is mounted on a short declined plate 23A carried by or forming a part of slidably adjustable carriage 23.

Motorized Means — Intermittent

It is desirable to limit the tension imposed on the incoming panel material 8 by the pull of the feed rolls 34, 35. Consequently, the supply roll is driven to maintain some slack in the panel material 8. To this end, a drive mechanism 38, carried by roll stand 3, includes a drive motor (not shown) suitably connected to the supply roll 6. This mechanism pivotally carries a 1st control arm 39, the outer end of which is bent to rest on a slack section of the panel material 8 extending from the supply roll to the top front guide roll 11. As the machine sews panel material, the slack section of the panel rises, moving the control arm 39 pivotally upwardly. Ultimately, before the slack is all used up, the control arm 39 strikes upper switch 40 to energize the drive mechanism 38 and feed panel material 8 toward the machine to increase the slack between the supply roll 6 and the top front guide roll 11. As the slack increases, the control arm 39 falls. Ultimately, the falling arm 39 operates lower switch 41 to stop the drive of the supply roll. This type of action repeats itself as the operation proceeds and thus maintains slack in the supply line.

Sensing Means

Figure 2:
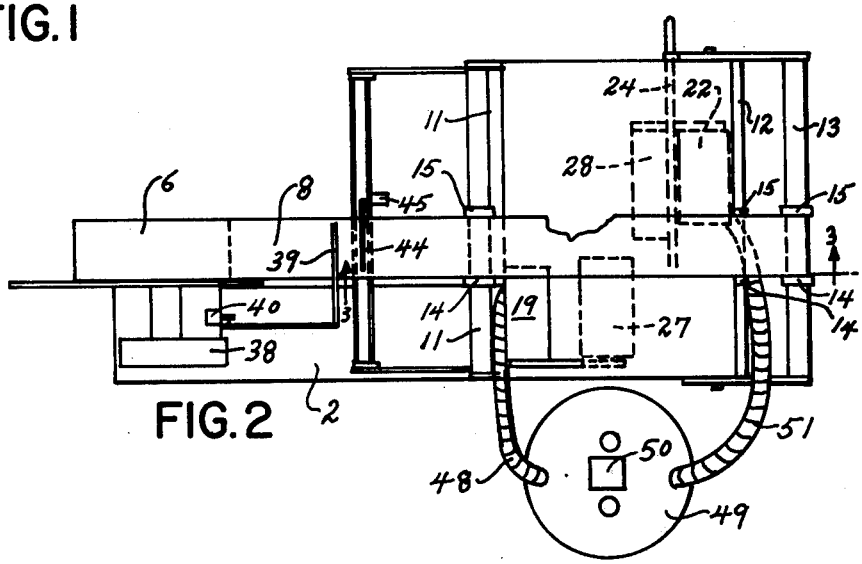
FIG. 2 is a top plan view thereof.

It is desirable to shut down the machine when the supply roll runs out of panel material. To this end, another control arm 44 is mounted to rest on the panel material between its slack section and the top front guide roll 11. This arm will drop when the tail end of the panel material 8 reaches it. In dropping, it operates switch 45, which is best seen in FIG. 2, to shut the machine down. Now the empty supply roll may be removed and replaced by a full supply roll. The lead edge of the panel material is then threaded under the 1st and 2nd control arms 39 and 44 and stapled to the tail end of the preceding panel material. The machine may now be restarted and production operation resumed.

Start and Stop Switches

The machine is provided with 1st and 2nd manually operable starting switches, one for each of the serging heads, each together with the rewind drive motor, a 3rd switch for starting both heads and the rewind motor and a 4th stop switch for shutting down whatever motors are running. None of these switches are illustrated.

Disposal of Waste

As noted, each of the 1st and 2nd sewing heads conventionally includes an edge trimmer (not shown) immediately in advance of and adjacent to its sewing area. The waste from the 1st sewing head 19 is directed into a suction hose 48 and sucked through that hose into collection barrel 49 by means of a suction motor (not shown) within barrel 49. An air jet (not shown) may be used to force the waste into the mouth of the hose. The waste collects in the barrel while the air escapes through an opening 50 in the top of the barrel. The waste from the 2nd sewing head 22 is directed (and preferably air jetted) into a suction hose 51 and sucked through that hose into the same collection barrel 49.

OPERATION

Since the operation of the machine should be clear from the foregoing, it should suffice to say: that the supply and rewind rolls 6 and 7 are mounted on a stand 3; that the adjustable collars 14 and 15 on the rolls 11, 12 and 13 are moved laterally to and fixed in a position wherein they conform the distance between collars 14 and 15 to the width of the panel; that the 1st sewing head 19 is set in operation and the material passed through the 1st sewing head 19 to begin the serging operation on one edge of the panel 8; that this operation continues while the material is directed around rolls 12 and 13 to approach the 2nd serging head 22; that the 2nd head is now started to begin the serging operation on the opposite edge of the panel; and that this operation continues as the panel is directed toward and attached to the rewind roll 7.

Normally a substantial amount of slack is initially provided in panel 8 between supply roll 6 and control arm 44. Normally also the feed rolls 34, 35 pull the panel through the machine at a rate fast enough to decrease the slack and cause control arm 39 to rise until it ultimately operates switch 40 to institute the rotation of supply roll 6. This rotation continues until the initial slack in the panel is restored. As a result, the control arm 39 is lowered into contact with switch 41 which shuts down the driving mechanism 38 rotating supply roll 6. This type of start and stop operation of the supply roll will be repeated as the serging operation proceeds. When the panel from supply roll 6 is all used up, the tail end of that panel will pass control arm 44 whereupon that control arm will drop to shut the machine. Now the empty supply roll 6 may be removed and replaced with a full supply roll. The panel from the replacement roll is then trained to extend along the panel path up to the tail end of the old panel. Here the lead end of the new panel is stapled to the tail end of the old panel so that the new panel will pass automatically through the machine once the operation is reinstituted. Once the lead end of the new panel reaches the rewind roll, it is disconnected from the tail end of the old panel. Now the full rewind roll is removed and replaced with an empty roll. The lead end of the new panel is now attached to the empty rewind roll and the operation reinstituted to empty the full supply roll and fill the empty rewind roll.

Before passing, it might be noted that the rearward and forward runs of the panel are vertically spaced to permit the 2nd serging sewing head to project into its operative position within that space.

It will be appreciated that by placing the supply and rewind rolls at the same end of the machine, a simpler and more compact machine not only results but the roll removal and replacement operations are facilitated.

Having described my invention, I claim:

1. A dual sewing head serging machine for serging the opposite edges of an elongate strip employed in the manufacture of mattresses and other products, comprising:

A. a turn member;

B. means for directing the strip in one direction along a 1st run of a given path extending to one side of said turn member and withdrawing it from the opposite side thereof along a 2nd run of said given path extending in the opposite direction, said path having 1. a 1st sewing section in the 1st run of said one direction, and
2. a 2nd substantially parallel sewing section in the 2nd run of said opposite direction;

C. a 1st serging sewing head of one hand type operatively mounted to serge one edge of said strip in said 1st sewing section; and D. a 2nd serging sewing hand of the same hand type operatively mounted to serge the opposite edge of said strip in said 2nd sewing section.

2. The machine of claim 1 wherein:

A. said 1st and 2nd runs are spaced to permit the 2nd serging sewing head to project into that space.

3. A border panel or like sewing machine structure comprising:

A. a frame having front and rear ends and presenting a U-shaped path for the flow of material 1st rearwardly through the machine along one run and then forwardly through the machine along another generally parallel run;

B. supply and rewind rolls mounted at the front end of the machine;

C. guide means for directing the material from the supply roll to the rewind roll along said U-shaped path;

D. a 1st serging sewing head of one hand type arranged along the rearward run of said path in operative position to serge one edge of said strip of material;

E. a 2nd serging sewing head of the same hand type arranged along the forward run of said path in operative position to serge the opposite edge of said strip material;

F. continuously energized motorized means for continuously operating the rewind roll to pull the strip through the machine and for continuously operating each of said 1st and 2nd serging sewing heads;

G. intermittently energized motorized means for intermittently rotating said supply roll to maintain some slack in the material between the supply roll of said rearward run and said 1st sewing head, said intermittent means including 1. means, responsive to the decrease and increase in said slack and operative, when the slack decreases to a predetermined low degree, to cause said motorized means to drive the supply roll in the direction required to increase said slack, and, when the slack increases to a predetermined high degree, to render said motorized means inoperative so as to stop the drive of the supply roll; and H. means for sensing the tail end of the strip and operative, before that end reaches the 1st sewing head, to shut down the machine.

* * * * *